US006195829B1

(12) United States Patent
Chen

(10) Patent No.: US 6,195,829 B1
(45) Date of Patent: Mar. 6, 2001

(54) BATH BRUSH

(76) Inventor: Ching-Chen Chen, No. 552, Kuang Fu Rd., Pei-Tou, Chang Huo Hsien (TW)

( * ) Notice: Subject to any disclaimer, the term of this patent is extended or adjusted under 35 U.S.C. 154(b) by 0 days.

(21) Appl. No.: 09/323,935

(22) Filed: Jun. 2, 1999

(51) Int. Cl.[7] ..... A47K 7/02; A61H 7/00

(52) U.S. Cl. ..... 15/110; 15/209.1; 15/223; 15/229.11; 601/135; 601/137; 601/138; D24/214; D28/63

(58) Field of Search ..... 15/110, 209.1, 15/210.1, 223–226, 229.11, 229.13; 601/134–138; D4/116; D24/200, 211, 214, 215; D28/63; D32/42

(56) References Cited

U.S. PATENT DOCUMENTS 2,414,321 * 1/1947 Miller ..... 601/138 X

FOREIGN PATENT DOCUMENTS

74399 * 7/1917 (CH) ..... 601/137
180637 * 1/1936 (CH) ..... 15/110
883427 * 3/1943 (FR) ..... 15/110
87/00425 * 1/1987 (WO) ..... 15/110

* cited by examiner

*Primary Examiner*—Mark Spisich
(74) *Attorney, Agent, or Firm*—Dougherty & Troxell

(57) ABSTRACT

A bath brush including: an elastic mesh tube which is axially pushed and gathered so as to continuously crimp the periphery thereof into a waved pattern; a handle including a connecting member, a grip member freely detachably assembled with the connecting member and a pair of massaging members, the connecting member being positioned on upper side of the elastic mesh tube and formed with at least one first connecting section disposed on the upper face of the connecting member and several fixing sections passing through the upper and lower faces of the connecting member, the grip member including at least one second connecting section for correspondingly connecting with the first connecting section, the pair of massaging members having a certain length, an upper end of each massaging member outward extending from a lateral side of the connecting member, while a lower end thereof extending downward; and at least one binder with a predetermined length and flexibility, the binder being conducted through the fixing sections to fix the elastic mesh tube on lower side of the connecting member between the lower ends of the two massaging members.

7 Claims, 4 Drawing Sheets

BATH BRUSH

BACKGROUND OF THE INVENTION

The present invention relates to a bath-used article, and more particularly to a bath brush having an elongated cleaning section and a grip section. The cleaning section is made of soft mesh material for achieving a more comfortable feeling and better cleaning effect.

A conventional bath belt or bath brush is used to clean human skin. For example, U.S. Pat. No. 5,560,071 discloses a bath belt with a certain length and flexibility. However, such bath belt can be hardly held by a user and hard sections exist the adjoining portions between adjacent ball bodies. This often leads to inconvenience and uncomfortable feeling in use. The inventor of this application has filed a patent application No. 09/271,146, U.S. Pat. No. 6,092,258, for eliminating the above shortcomings. The bath article of the above patent application can be easily assembled and provide a large area of brushing section which is able to achieve a comfortable feeling in use.

SUMMARY OF THE INVENTION

It is a primary object of the present invention to provide an improved bath brush of the above patent application of the same inventor. The bath brush includes massaging members which during cleaning the skin serve to massage the muscle of the user's body and eliminate the tiredness of the muscle.

It is a further object of the present invention to provide the above bath brush which has versatile patterns and enhanced appearance.

It is still a further object of the present invention to provide the above bath brush in which the handle can be freely replaced as desired.

According to the above objects, the bath brush of the present invention includes: an elastic mesh tube which is axially pushed and gathered so as to continuously crimp the periphery thereof into a waved pattern; a handle including a connecting member, a grip member freely detachably assembled with the connecting member and a pair of massaging members, the connecting member being positioned on upper side of the elastic mesh tube and formed with at least one first connecting section disposed on the upper face of the connecting member and several fixing sections passing through the upper and lower faces of the connecting member, the grip member including at least one second connecting section for correspondingly connecting with the first connecting section, the pair of massaging members having a certain length, an upper end of each massaging member outward extending from a lateral side of the connecting member, while a lower end thereof extending downward; and at least one binder with a predetermined length and flexibility. The binder is conducted through the fixing sections to fix the elastic mesh tube on lower side of the connecting member between the lower ends of the two massaging members. Therefore, the bath brush is able to achieve double effects of cleaning and massaging.

The present invention can be best understood through the following description and accompanying drawings wherein:

DETAILED DESCRIPTION OF THE PREFERRED EMBODIMENTS

Figure 1:
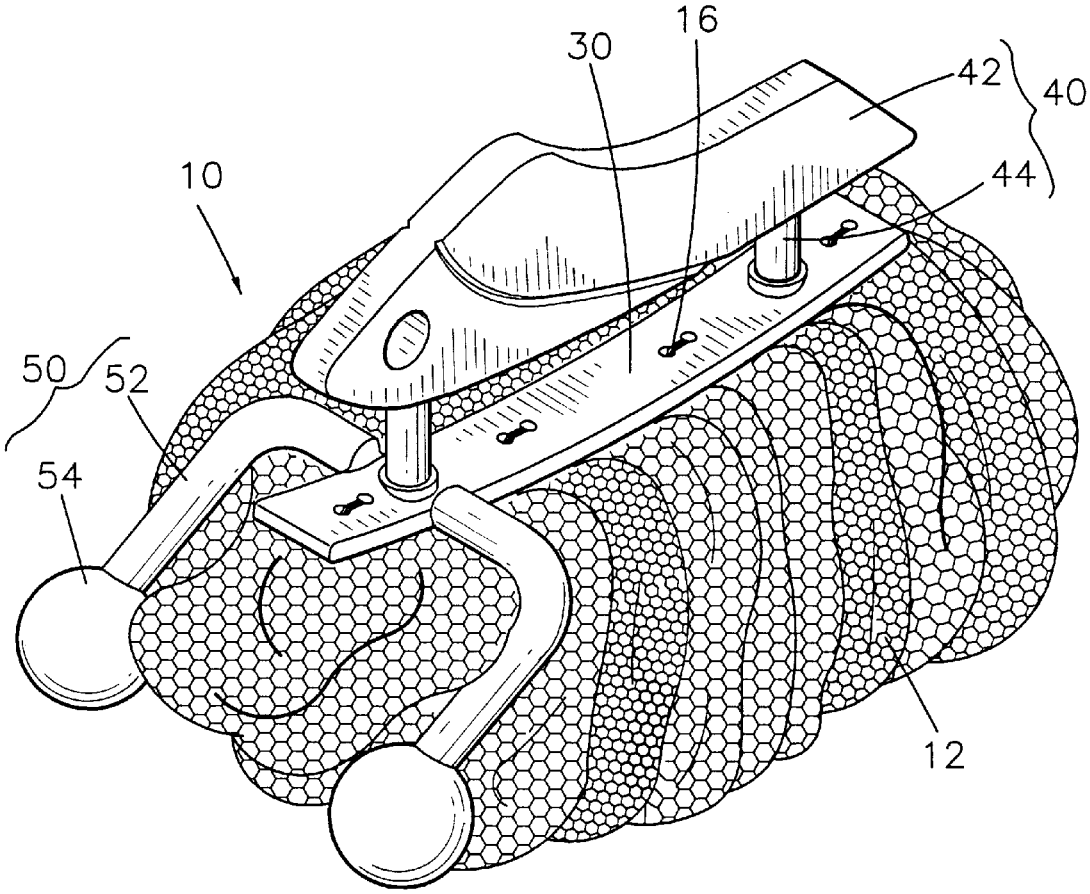
FIG. 1 is a perspective assembled view of a first embodiment of the present invention.
Figure 2:
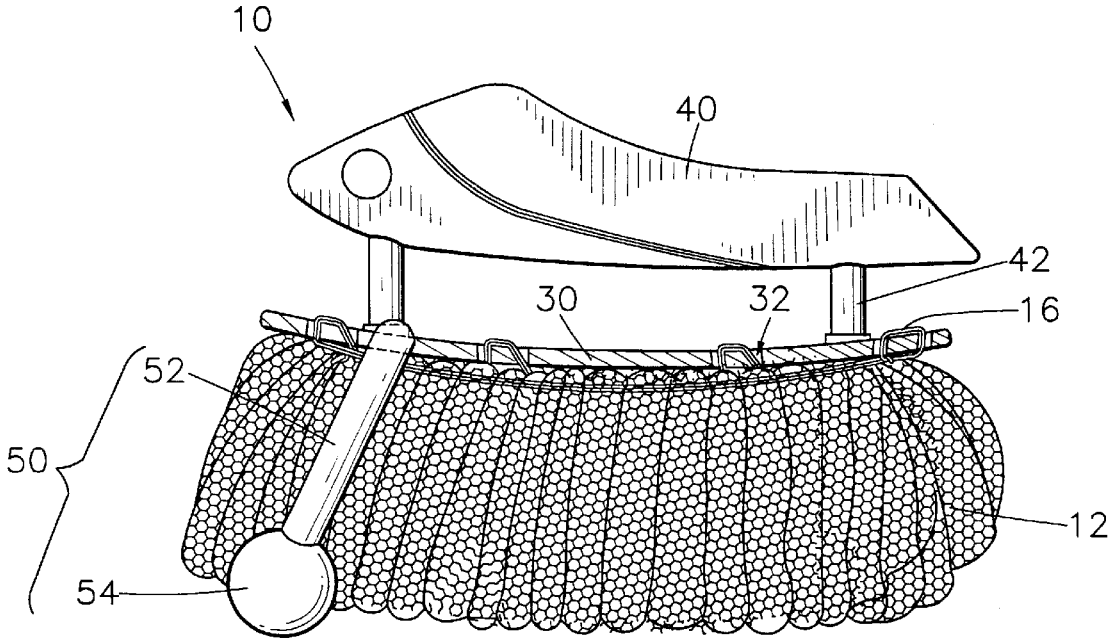
FIG. 2 is a side sectional view of the first embodiment of the present invention.
Figure 3:
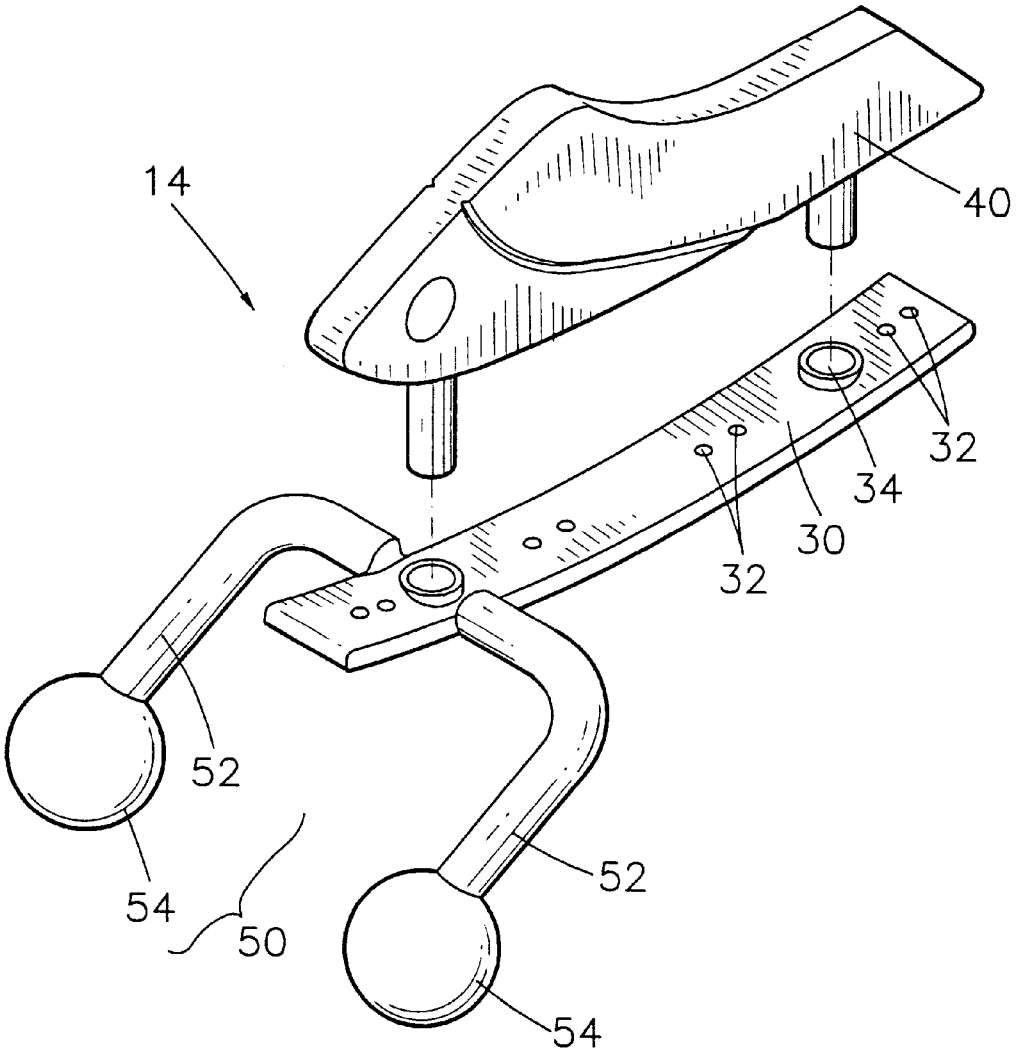
FIG. 3 is a perspective exploded view of the handle of the first embodiment of the present invention.

Please refer to FIGS. 1 to 3. The bath brush 10 of the present invention includes an elastic mesh tube 12, a handle 14 and a binder 16 for binding the mesh tube 12 on the handle 14.

The elastic mesh tube 12 is made of plastic material by integral molding. The mesh tube 12 has a certain length, diameter and elasticity and is formed with a plurality of lozenge or rectangular meshes. When manufacturing the bath brush 10 of the present invention, the mesh tube 12 is anally pushed and gathered so as to crimp the periphery thereof into a waved pattern.

The handle 14 includes a connecting member 30, a grip member 40 and a pair of massaging members 50. The connecting member 30 is a slightly curved slat formed with four pairs of fixing through holes 32. In addition, two first connecting sections 34 are formed on the upper face of the connecting member 30 and respectively spaced from front and rear ends thereof by a certain distance. The first connecting sections 34 are two sockets with a certain depth. The grip member 40 includes a main body 42 for a user's handle to grip and a pair of cylindrical second connecting sections 44 disposed under lower end of the main body 42. The second connecting sections 44 can be inserted into the corresponding first connecting sections 34 so as to fixedly connect the grip member 40 with the connecting member 30. The massaging members 50 are connected with the connecting member 30 and spaced from the front end thereof by a certain distance. Each massaging member 50 includes an extension arm 52 with a circular cross-section and a ball member 54. An upper end of the extension arm 52 outward extends from a lateral side of the connecting member 30 by a certain length, while a lower end thereof inclinedly extends downward and forward. The ball member 54 is integrally molded on a free end of the extension arm 52. The diameter of the ball member 54 is larger than that of the extension am 52.

The binder 16 is a fine string with a certain length, which is conducted through the fixing through holes 32 and around the crimped elastic mesh tube 12 so as to fix the mesh tube 12 on lower side of the connecting member 30. At this time, the mesh tube 12 extends along the length of the connecting member 30 in an elongated pattern so as to provide a large area of brushing section. A part of the elastic mesh tube 12 is positioned between two massaging members 50.

In FIG. 2, one single binder 16 is continuously wound around the mesh tube 12 for binding the same under the connecting member 30. In actual application, alternatively, the elastic mesh tube 12 can be bound under the connecting member 30 by several fine strings corresponding to the respective fixing through holes 32.

According to the above arrangement, the present invention has advantages as follows:

1. The connecting member 30 is freely detachably assembled with the grip member 40. Therefore, many different patterns of main bodies 42 can be replaceably assembled with one connecting member 30 so as to attract a child to use the bath brush and achieve a good cleaning effect.

2. The massaging members 50 project from the front end of the handle 14 and serve to massage the muscle of the user's body and eliminate the tiredness of the muscle.

3. The free ends of the massaging members 50 are disposed with ball members which can be smoothly slided over the skin of the user in cooperation with the hot water or bath lotion without hurting human body. The ball members are able to stimulate vital points of human body and achieve a comfortable feeling.

Figure 4:
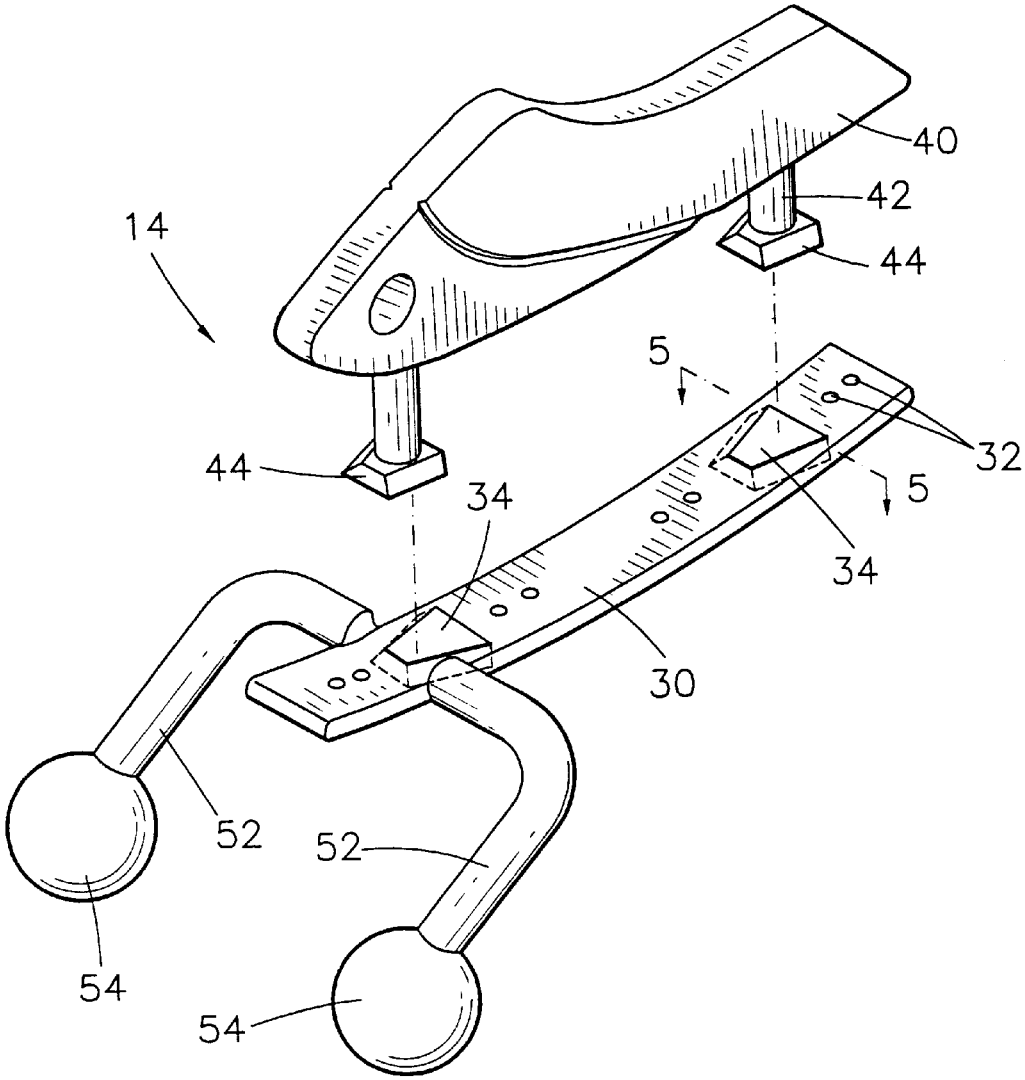
FIG. 4 is a perspective exploded view of the handle of a second embodiment of the present invention.
Figure 5:
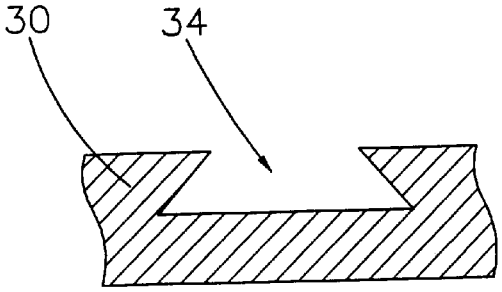
FIG. 5 is a section view taken along line 5—5 of FIG. 4, showing the first connecting section of the second embodiment of the present invention.

FIGS. 4 and 5 show another embodiment of the present invention, in which the first and second connecting sections 34, 44 are designed with another shape. The first connecting section 34 is formed as a wedge channel with a certain length and a dovetail cross-section. The second connecting section 44 is formed as a wedge block with a length shorter than that of the first connecting section 34. Accordingly, the second connecting section 44 can be downward fitted into a rear end of the first connecting section 34 with a larger width. Then the second connecting section 44 is moved forward to insert with a front end of the first connecting section 34 with less width. Therefore, the grip member can be firmly connected with the connecting member by another different measure.

The above embodiments are only used to illustrate the present invention, not intended to limit the scope thereof Many modifications of the above embodiments can be made without departing from the spirit of the present invention.

What is claimed is:

1. A bath brush comprising:

an elastic mesh tube having a predetermined length and diameter, the mesh tube being axially pushed and gathered so as to continuously crimp the periphery thereof into a waved pattern;

a handle including a connecting member, a grip member freely detachably assembled with the connecting member and a pair of massaging members, the connecting member being positioned on an upper side of the elastic mesh tube and formed with at least one first connecting section disposed on an upper face of the connecting member and a plurality of fixing sections passing through upper and lower faces of the connecting member, the grip member including at least one second connecting section correspondingly connected with the first connecting section, the pair of massaging members having a predetermined length, an upper end of each massaging member extending outwardly from a lateral side of the connecting member, a lower end thereof extending downwardly; and at least one flexible binder with a predetermined length, the binder being conducted through the plurality of fixing sections to fix the elastic mesh tube on a lower side of the connecting member between the lower ends of the two massaging members.

2. The bath brush as claimed in claim 1, wherein the fixing sections comprise pairs of through holes.

3. The bath brush as claimed in claim 1, wherein the first connecting section has a socket and the second connection section comprises a cylindrical post inserted into the socket.

4. The bath brush as claimed in claim 1, wherein the first connecting section comprises a wedge channel, and the second connecting section comprises a wedge block disposed at a free end of a post of the grip member.

5. The bath brush as claimed in claim 1, wherein each massaging member includes an extension arm and a ball member fixed at a free end of the extension arm.

6. The bath brush as claimed in claim 5, wherein the ball member has a diameter larger than that of the extension arm.

7. The bath brush as claimed in claim 1, wherein an upper end of each massaging member is disposed on a lateral side of the connecting member near a front end thereof, while a lower end of the massaging member extends downwardly and is inclined forwardly.

* * * * *